US005660365A

United States Patent [19]

Glick

[11] Patent Number: 5,660,365

[45] Date of Patent: Aug. 26, 1997

[54] DISPLAY EASEL

[76] Inventor: Isaac N. Glick, 7103 - 111 Street, Edmonton, Alberta, Canada, T6G 1G9

[21] Appl. No.: 536,480

[22] Filed: Sep. 29, 1995

[51] Int. Cl.[6] ..... A47B 97/04

[52] U.S. Cl. ..... 248/459; 248/174

[58] Field of Search ..... 248/459, 450, 248/453, 455, 174; 206/45.29

[56] References Cited

U.S. PATENT DOCUMENTS

| | | | |
|---|---|---|---|
| 591,089 | 10/1897 | Berbecker | 248/459 |
| 777,658 | 12/1904 | Bird | 248/444.1 |
| 1,301,797 | 4/1919 | Ziegler | 248/174 X |
| 1,399,507 | 12/1921 | Mills, Jr. | 248/459 |
| 1,439,719 | 12/1922 | Whipple | 248/459 |
| 1,488,650 | 4/1924 | Schlitzer | 248/459 |
| 1,555,429 | 9/1925 | Miller | 248/459 |
| 1,666,400 | 4/1928 | Rose | 248/459 |
| 2,611,572 | 9/1952 | La Rocca | 248/147 |
| 2,832,176 | 4/1958 | Vergeer | 248/473 X |
| 5,029,798 | 7/1991 | Clark | 248/459 |
| 5,351,882 | 10/1994 | Krautsack | 248/459 X |
| 5,388,798 | 2/1995 | Glick | 248/459 |

FOREIGN PATENT DOCUMENTS

| | | |
|---|---|---|
| 113330 | 2/1918 | United Kingdom . |

*Primary Examiner*—Ramon O. Ramirez
*Attorney, Agent, or Firm*—Sheridan Ross P.C.

[57] ABSTRACT

The easel in the non-assembled state is a flat sheet of stiff, bendable resilient plastic. It comprises a rectangular central panel and a pair of triangular side sections. A scored joint line extends along the junction of each side section and the panel. The side sections can be folded back to support the panel in a rearwardly inclined, upstanding position. Bell-shaped partial cutouts can be bent to engage and lock the side sections in place. Hook-like partial cutouts at the base of the panel can be bent forward to support and hold display items of variable thickness.

2 Claims, 4 Drawing Sheets

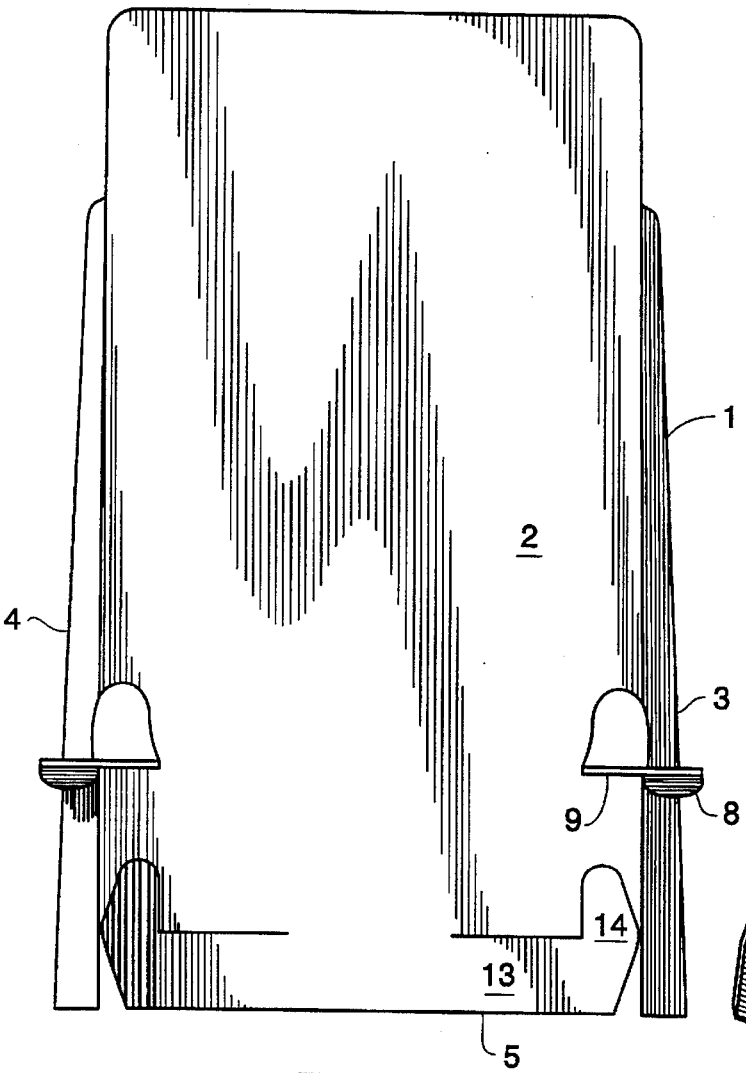
Fig. 2
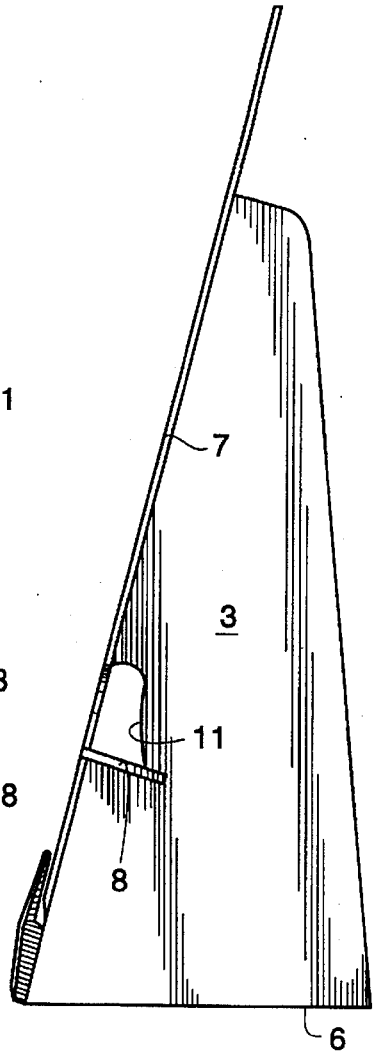
Fig 3
Fig. 4
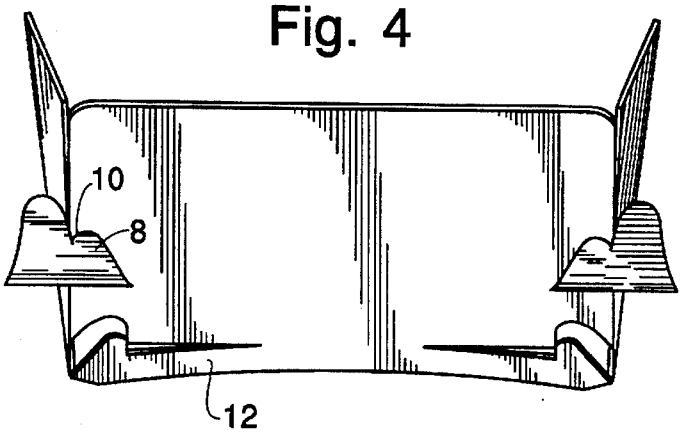

DISPLAY EASEL

FIELD OF THE INVENTION

This invention relates to an easel for supporting a generally flat display items, such as an open book or a card. More particularly, the easel takes the form of a flat plastic sheet having partial cutouts and bid lines so that the sheet can be formed into an upstanding easel.

BACKGROUND OF THE INVENTION

It is desirable to provide a low cost easel which is convertible between a flat shipping/storage position and a free-standing upright position in which it can suspend and support a generally flat display item.

It is also desirable that the easel be capable of supporting display items of different thicknesses, such as an open book, brochures or cards.

It is the objective of the present invention to provide an easel that meets these objectives.

SUMMARY OF THE INVENTION

The invention comprises:

a flat sheet of stiff, bendable, resilient plastic;

the sheet comprises a preferably rectangular, central panel and a pair of substantially triangular side sections (referred to as "wings"), the wings having bottom edges which preferably extend upwardly at a small angle relative to the bottom edge of the panel;

the sheet is scored or otherwise weakened along the joint line extending along the junction of each wing and the panel, so that the wings can be folded rearwardly to adopt a generally perpendicular position relative to the panel—in this position, the angled bottom edges of the wings cause the panel to adopt a rearwardly inclined and upstanding position;

the sheet having a pair of partial cutouts, preferably being bell-shaped and having a central slit in the upper end. Each cutout bridges a wing and the panel at a joint line, the cutout being integral with the panel along a joinder line extending along the cutout's bottom edge. The cutout may be bent rearwardly to engage the adjacent wing to lock it in the supporting position;

the sheet further having a second pair of partial cutouts of hook-like configuration formed in the panel adjacent its bottom edge in laterally spaced relationship. Each such hook-like cutout has a shank segment, integral at its end with the panel and parallel with the panel's bottom edge, and a hook segment extending upwardly therefrom, The hook-like cutouts can thus be bent forwardly out of the panel to suspend and hold the display item so that it rests against the panel in an upwardly and rearwardly inclined position.

Otherwise stated, an easel in the form of a single ply of flat plastic sheet is provided by the use of fold lines and partial cutouts. The sheet can be converted to a free-standing upright easel ready to support a card or book in a slightly angled upright display position, The resiliently bent hook-like members can accommodate display items of various thicknesses and they press against the item with a positive force.

DESCRIPTION OF THE DRAWINGS

FIG. 2 is a front view of the easel of FIG. 1;

FIG. 3 is a side view of the easel of FIG. 1;

FIG. 4 is a downwardly directed perspective view of the easel of claim 1;

DESCRIPTION OF THE PREFERRED EMBODIMENT

Figure 1:
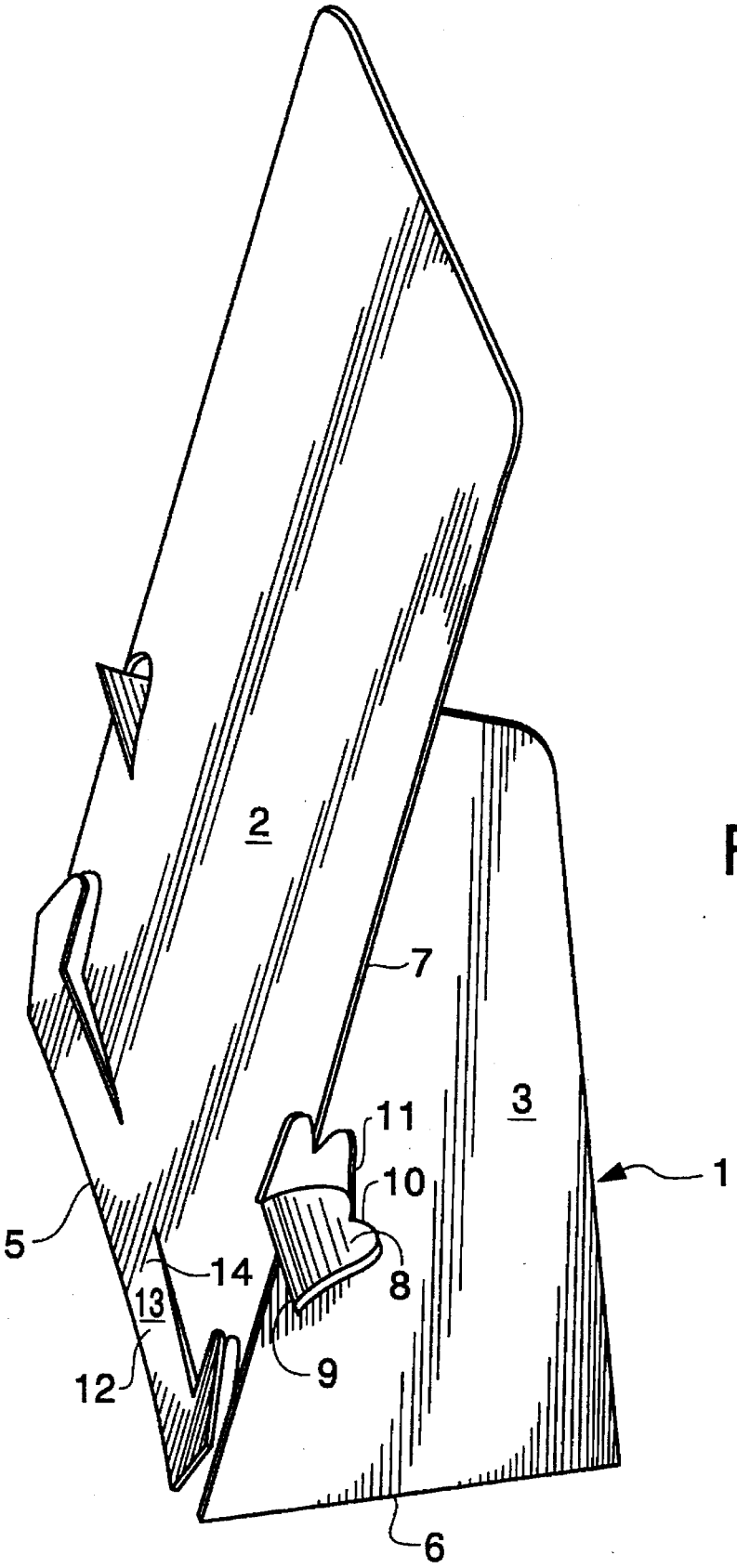
FIG. 1 is a perspective view of the easel in the upstanding operative position.
Figure 5:
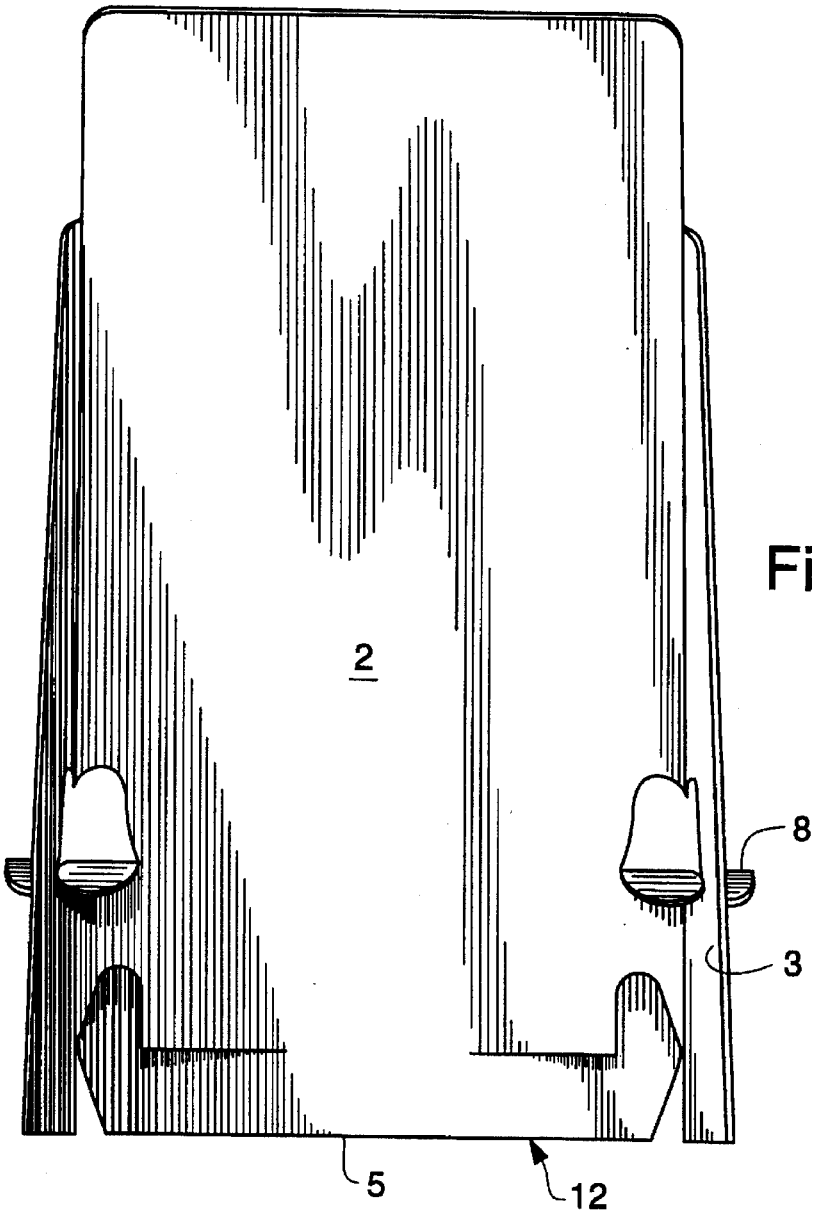
FIG. 5 is a rear view of the easel.
Figure 6:
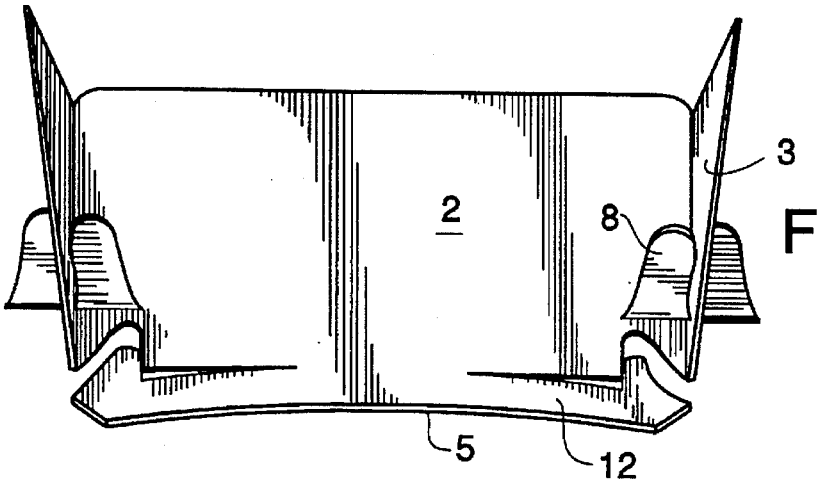
FIG. 6 is a perspective view from the rear of the easel.
Figure 7:
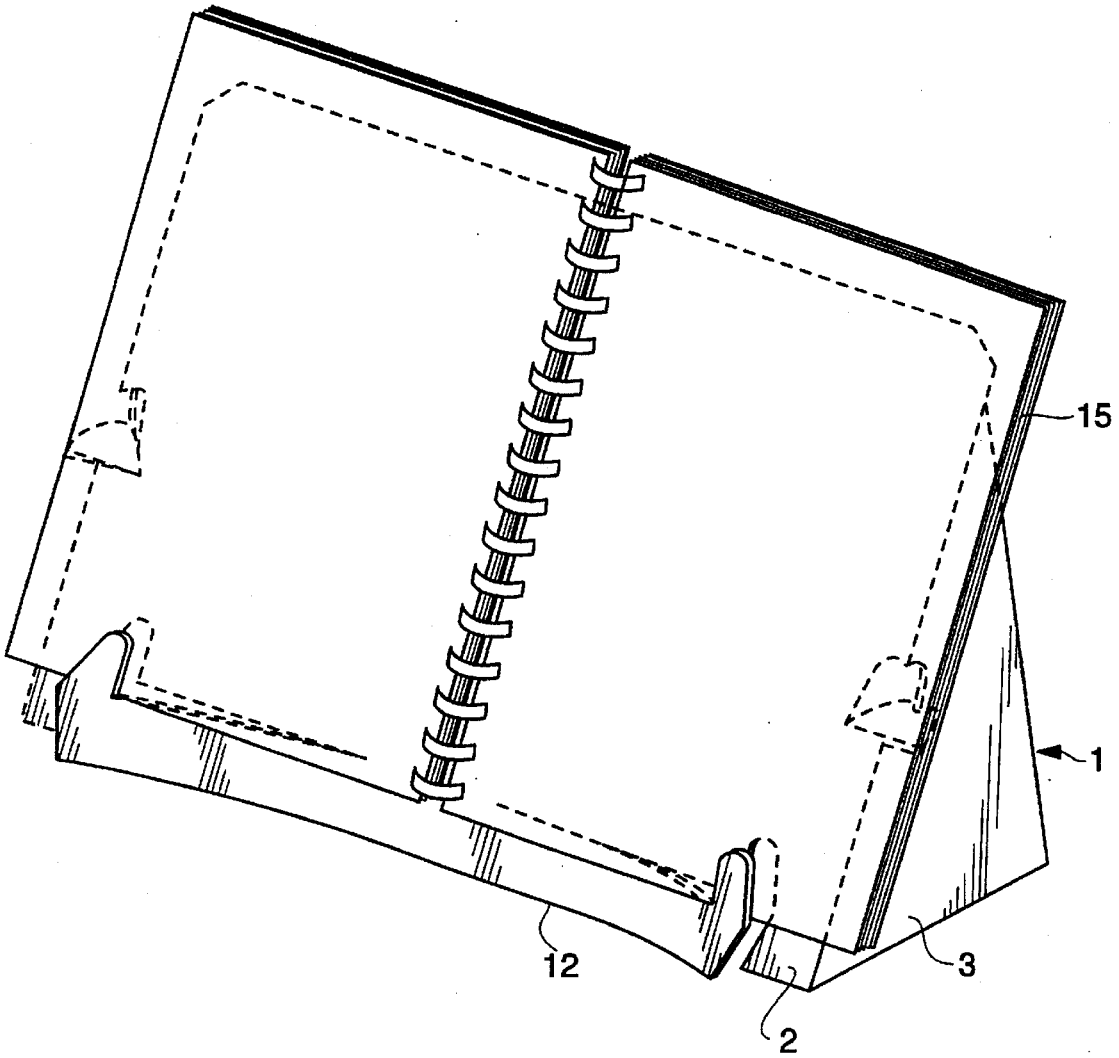
FIG. 7 is a perspective front view of the easel carrying a display item.

The easel comprises a flat sheet 1 having a central panel 2 and a pair of side wings 3, 4 integral with the panel. The sheet 1 is formed of stiff, bendable resilient plastic. I use 0.045 or 0.055 gauge polyethylene available from Cadillac Plastics Ltd., Edmonton, Alberta.

The panel 2 is generally rectangular in form and has a flat bottom edge 5. The wings 3, 4 are generally triangular in configuration. The bottom edge of each wing extends upwardly at a small acute angle relative to the panel bottom edge 5. The sheet 1 is scored or weakened along the joint line 7 extending along the junction of each wing 3, 4 with the panel 2. Thus the wings 3, 4 can be easily bent back to adopt a supporting position perpendicular to the panel 2. Due to the angularity of the edges 6, the panel 2 adopts an upstanding but rearwardly inclined position in the supported mode.

A pair of ball-shaped partial cutouts 8 are provided, one at the midpoint of each joint line 7. Each cutout 8 bridges the panel and adjacent wing. The cutout 8 is Integral with the panel along a joinder line 9 at its bottom edge. It has a vertical central indentation 10 at its upper end. The cutout 8 may therefore be bent back to engage the adjacent edge 11 of the wing by receiving the edge 11 in the indentation 10.

The panel 2 has a pair of laterally spaced, hook-like partial cutouts 12 formed along its bottom edge 5. Each cutout 12 comprises a shank segment 13, extending parallel to the bottom edge 5, and a hook segment 14 extending upwardly therefrom. The shank segment 13 is integral at its end 14 with the panel 2. The hook-like cutouts can be bent forwardly to support and suspend the display item 15 and press against the item's front surface 16 to hold it in place.

The embodiments of the invention in which an exclusive property or privilege is claimed are defined as follows:

1. An easel for supporting a generally flat display item, comprising:

a flat sheet of stiff, bendable, resilient plastic;

said sheet comprising a generally rectangular central panel, having side edges and a bottom edge, and at least a pair of substantially triangular side sections integral with the central panel and extending outwardly along its side edges, whereby each side section joins the central panel along a joint line, said sheet being scored along the joint lines so that the side sections may fold rearwardly to support the panel in an upstanding, rearwardly inclined position;

said sheet having at least a pair of partial cutouts, each such cutout bridging a side section and the panel along a joint line, said cutout being integral with the panel along a joinder line extending along the cutout's bottom edge, so that each cutout may be bent rearwardly, each cutout being operative to engage the adjacent rearwardly folded side section to lock it in the supporting position to provide an upright easel having only a single ply;

said sheet having at least a pair of partial cutouts of hook-like configuration formed in the panel adjacent its bottom edge in laterally spaced relationship, each hook-like cutout having a shank segment integral at its end with the panel and extending parallel with the panel bottom edge and a hook segment extending upwardly therefrom, said hook-like cutouts being bendable forwardly to suspend the display item so that it rests against the panel in an upwardly and rearwardly inclined position, said hook-like cutouts being operative to lightly press the display item against the panel.

2. The easel as set forth in claim 1 wherein:

each cutout for locking a side section has a bell-like configuration and forms a central indentation at its upper end for receiving the edge of the adjacent side section to lock it in the supporting position.

* * * * *